United States Patent [19]

White

[11] Patent Number: 4,556,344

[45] Date of Patent: Dec. 3, 1985

[54] COMBINATION EXPANSION SHELL AND RESIN SECURED MINE ROOF ANCHOR ASSEMBLY

[75] Inventor: Claude C. White, Birmingham, Ala.

[73] Assignee: Birmingham Bolt Company, Birmingham, Ala.

[21] Appl. No.: 578,316

[22] Filed: Feb. 13, 1984

Related U.S. Application Data

[63] Continuation of Ser. No. 312,009, Oct. 16, 1981, abandoned.

[51] Int. Cl.[4] ..... E21D 20/02

[52] U.S. Cl. ..... 405/261; 405/259; 411/47

[58] Field of Search ..... 405/259-261; 411/63, 67, 45, 47, 57

[56] References Cited

U.S. PATENT DOCUMENTS

| | | | |
|---|---|---|---|
| 3,188,815 | 6/1965 | Schuermann et al. . | |
| 3,618,326 | 11/1971 | Montgomery | 405/261 |
| 3,702,060 | 11/1972 | Cumming | 405/261 |
| 4,023,373 | 5/1977 | Hipkins . | |
| 4,100,748 | 7/1978 | Hansen | 405/259 |
| 4,160,614 | 7/1979 | Koval | 405/259 |
| 4,187,040 | 2/1980 | Donan | 405/261 X |
| 4,278,006 | 7/1981 | Lobello | 405/259 X |
| 4,295,761 | 10/1981 | Hansen | 405/261 |
| 4,299,515 | 11/1981 | Yates et al. | 405/261 |
| 4,419,805 | 12/1983 | Calandra | 405/259 X |
| 4,483,645 | 11/1984 | White et al. | 405/261 |

*Primary Examiner*—Cornelius J. Husar
*Assistant Examiner*—Nancy J. Stodola
*Attorney, Agent, or Firm*—Shlesinger, Arkwright, Garvey & Fado

[57] ABSTRACT

A combination expansion shell and resin secured mine roof anchor assembly comprising an elongated bolt which carries rebar and an expansion shell. The assembly is inserted into a mine roof opening, in the back end of which is positioned a resin and catalyst cartridge. The cartridge is ruptured by the assembly allowing the resin and catalyst to gravitate downwardly, where they are mixed together by the rebar upon rotation of the bolt. The bolt is rotated a predetermined number of revolutions to obtain proper mixing of the resin and catalyst preparatory to setting, after which the continued rotation of the bolt in the same direction effects movement of the expansion shell into gripping engagement with the mine roof.

9 Claims, 8 Drawing Figures

COMBINATION EXPANSION SHELL AND RESIN SECURED MINE ROOF ANCHOR ASSEMBLY

This application is a continuation of application Ser. No. 06/312,009, filed Oct. 16, 1981, now abandoned.

BACKGROUND OF THE INVENTION

This invention relates to the securing of anchor bolts in drilled openings in a mine roof for supporting the roof.

For many years, mine roof bolts of the expansion shell type have been widely used for supporting mine roofs. More recently, resin type anchors have been employed. In the resin type anchor, a resin and catalyst cartridge is inserted into the back of a mine roof opening, following which an anchor bolt is forced upwardly into the opening, thereby rupturing the cartridge to permit the resin and catalyst to gravitate downwardly between the bolt and the wall of the opening. Upon mixing of the catalyst and the resin, the resin sets to secure the bolt in the mine roof.

Difficulty has been experienced in properly mixing the resin and catalyst to effect the greatest securing effect, and preventing either undermixing or overmixing of the resin and catalyst. Attempts have been made to provide a combination anchor of the present type wherein anchoring of the bolt is carried out by means of an expansion shell acting in combination with resin, as illustrated in U.S. Pat. No. 3,702,060 issued Nov. 7, 1972, U.S. Pat. No. 4,160,614 issued July 10, 1979 and U.S. Pat. No. 4,194,858 issued Mar. 25, 1980. Additionally, U.S. Pat. No. 3,188,815 issued June 15, 1965 discloses an anchor bolt assembly wherein a resin and catalyst cartridge is punctured by the tip of the roof bolt, following which the bolt is rotated a certain number of times in order to mix the resin and catalyst, following which an expansion shell carried by the bolt is urged to its expanded position to grip the mine roof.

It is found, however, that with all of the above combination anchors, proper mixing of the resin and catalyst is a problem, and overmixing or undermixing of the resin occurs, with a consequent reduction in the effectiveness of the resin in securing the bolt in the mine roof opening.

SUMMARY OF THE INVENTION

The present invention is a combination expansion shell and resin secured mine roof anchor assembly wherein the resin and catalyst are thoroughly mixed when the roof bolt is rotated and, when the two are mixed to a degree to effect maximum securement of the assembly in the mine roof opening, continued rotation of the roof bolt results in activation of the expansion shell into gripping engagement with the roof wall. Securement of the assembly in place is therefore carried out in one continuous operation by rotation of the anchor bolt in one direction only, as opposed to a two-stage operation, one for properly mixing the resin and catalyst, and the second for expanding the shell into engagement with the opening wall.

The assembly includes an anchor bolt having a head at one end and a threaded shank at the other end for threaded engagement with an expansion shell, a reinforcing bar, or rebar, being mounted on, and rotatable with, the anchor bolt between the head and expansion shell.

The expansion shell includes shell segments having wall-engaging ribs on the outer surface thereof and a tapered inner surface for sliding engagement with the tapered wall of a cone nut which is initially mounted on the threaded shank in spaced relation to the expansion shell and adapted to move axially through the shell for expanding the shell segments. A bail member of substantially inverted U-shape extends upwardly from the shell segments, the bail member preferably being made of relatively rigid metallic material and including a pair of elongated legs, the upper ends of which are joined by an intermediate connecting portion which overlies the cone nut and serves to limit the longitudinal movement of the anchor bolt relative to the expansion shell. The rigidity of the bail member prevents accidental displacement thereof from the cone nut grooves.

A portion of each of the legs of the bail member is bent inwardly at a point intermediate its length, to provide a restricted passageway which is less than the diameter of the cone nut, and prevents the premature engagement of the cone nut with the expansion shell.

Upon rotation of the bolt and the rebar mounted thereon, the resin and catalyst are automatically mixed together to provide a setting agent between the rebar and the mine roof opening wall for securely retaining the assembly at that point. Simultaneously, the cone nut is slowly moved downwardly on the bolt towards the expansion shell. By locating the cone nut a certain distance from the expansion shell, the bolt and rebar are rotated a predetermined number of revolutions to effect proper mixing of the resin and catalyst before the cone nut engages the expansion shell, at which time continued rotation of the bolt causes axial movement of the cone nut through the expansion shell, thereby forcing the expansion shell into gripping engagement with the mine roof opening wall.

DESCRIPTION OF THE INVENTION

Figure 1:
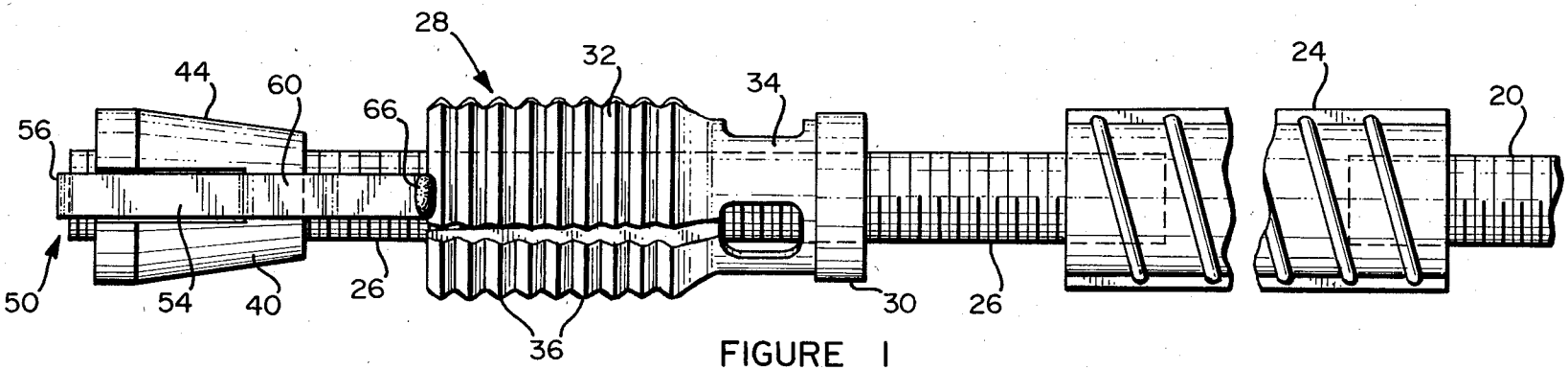
FIG. 1 is a fragmentary elevational view of the anchor assembly of the present invention.

The anchor assembly of the present invention includes an elongated bolt comprising a first part 20 to one end of which is connected a head 22. The opposite end of first part 20 is threadedly engaged with one end of rebar 24 of conventional type and of any suitable length. The bolt further includes a second threaded part 26 which is threadedly engaged with the other end of rebar 24, the opposite end of part 26 being threadedly engaged with an expansion shell generally designated 28.

Expansion shell 28 includes a lower collar or ring 30 which surrounds bolt part 26 and a plurality of like, wedge segments 32 which are connected to collar 30 by reduced neck portions 34. Wedge segments 32 are slightly spaced apart and are of arcuate conformation in cross section. The outer surface of each wedge segment is provided with a series of transverse ribs 36 adapted for gripping engagement with the mine roof wall when the expansion shell is actuated. As shown to advantage in FIG. 2, the inner surface of each wedge segment 32 is inwardly tapered from top to bottom as shown at 38.

Expansion shell 28 further includes a cone or wedge nut 40 having an axial threaded bore 42 for threaded engagement with threaded bolt part 26. The outer surface of cone nut 40 is tapered inwardly from a point near the top to its bottom thereof, as indicated at 44, for sliding engagement with the tapered wall 38 of wedge segments 32. Diametrically opposite side edges of cone nut 40 are cut away to provide longitudinal grooves 46 and 48 for purposes which will hereinafter be more fully set out.

In accordance with the present invention, there is also provided an inverted U-shape bail member generally designated 60 which extends upwardly from expansion shell 28. Bail member 50 is preferably made of relatively rigid material of uniform width and thickness and includes a pair of like, spaced legs 52 and 54, the upper ends of which lie within grooves 46 and 48 of cone nut 40 to insure proper engagement with the latter. The upper ends of legs 52 and 54 are joined by a connecting portion 56 which overlies the cone nut. At a point intermediate their length, legs 52 and 54 are bent inwardly at an angle "a" to provide inwardly bent portions 58 and 60. For optimum results, bent portions 58 and 60 extend at approximately a 5° angle to the main portions of legs 52 and 54.

The lower limits of bent portions 58 and 60 issue into outwardly bent portions 62 and 64, the ends of which are welded, or secured in any suitable manner to diametrically opposed portions of wedge segments 32, as indicated at 66 and 68.

Figure 2:
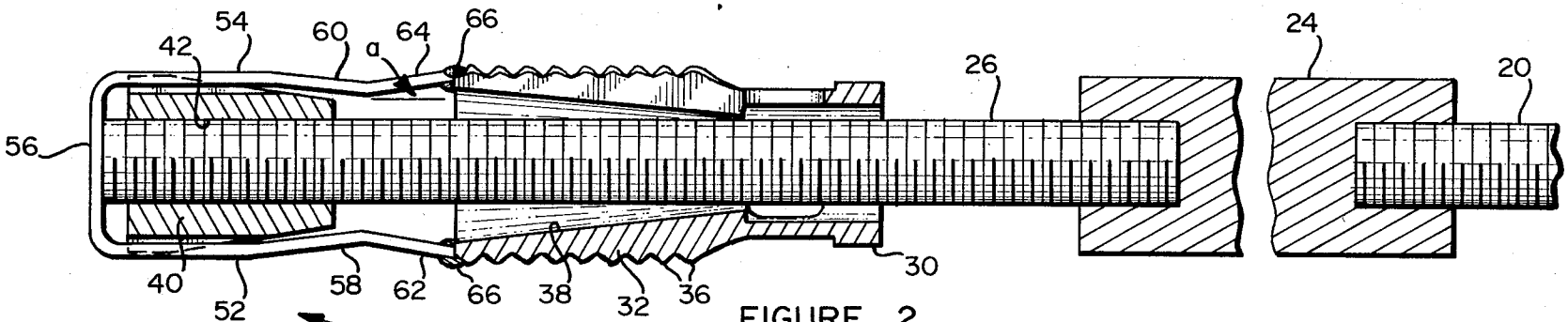
FIG. 2 is a fragmentary longitudinal sectional view of the present anchor assembly, portions thereof being shown in section.
Figure 4:
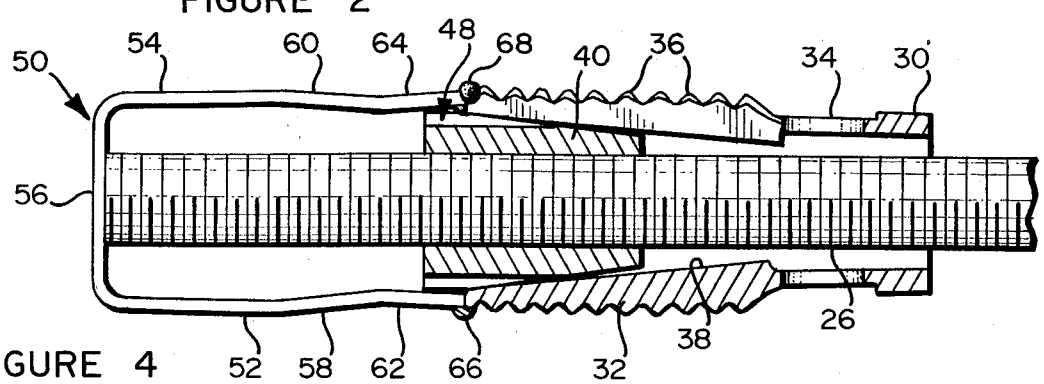
FIG. 4 is a fragmentary longitudinal sectional view of the anchor assembly, showing the expansion shell in expanded position.
Figure 3:
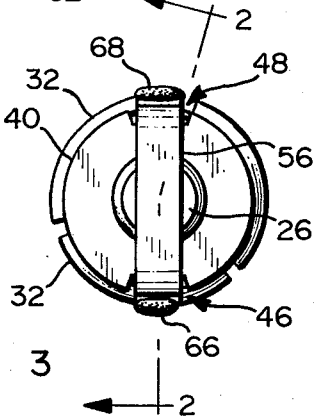
FIG. 3 is a top plan view of the present anchor assembly.

As shown in FIGS. 2 and 4, inwardly bent portions 58 and 60 provide a restricted passageway through which cone nut 40 passes when the elongated bolt is rotated relative to expansion shell 28.

It will be further noted from FIGS. 1 and 2 that the lower end of cone nut 40 is initially located at a certain distance from wedge segments 32 of the expansion shell in order that the elongated bolt and rebar may be rotated a predetermined number of revolutions before wedge segments 32 are expanded into securing engagement with the mine opening wall. This enables the resin and catalyst gravitating downwardly between rebar 24 and the wall of the mine roof opening to be properly mixed prior to setting up when expansion shell wedge segments 32 are expanded outwardly into securing engagement with the mine wall.

It will also be noted from a consideration of FIG. 2 that the lowermost part of cone nut 40 lies above the most restricted part of the passageway formed by bent bail member portions 58 and 60, thereby preventing premature engagement of the expansion shell and cone nut which might otherwise occur.

The distance between cone nut 40 and the expansion shell is determined by the number of revolutions of the elongated bolt and the rebar to effect proper mixing of the resin and catalyst.

It is further noted that, when cone nut 40 moves through the restricted passageway formed by bent portions 58 and 60, a slight flexing of the bent portions occurs, with resultant slight expansion of the wedge segments, thereby urging the segments into frictional engagement with the opening wall to prevent rotation of the expansion assembly, without urging the segments into gripping engagement with the wall.

The distance between the cone nut and the shell enables bail member 50 to be made with relatively long legs, thereby permitting the use of thicker, more rigid, strap material for making the bail member, while at the same time, permitting the necessary spring action of the legs which will not resist the expanding action of the wedge segments. It has been found that a steel strap of approximately 5/16 inches in width and 3/32 inches to 5/32 inches in thickness obtains the desired results, a thickness of $\frac{1}{8}$ inch having been found to produce the best results.

In the initial position of use of the anchor assembly of the present invention in a mine roof opening, the component parts of the assembly are positioned as shown in FIGS. 1 and 2, with the upper end of threaded bolt part 26 in engagement with connecting portion 56 of bail member 50, cone nut 40 being in proximate relation to connecting member 56, and the lower end of cone nut 40 being in predetermined spaced relation to wedge segments 32. As set out above, this relationship is important in order to obtain the proper mixing of the resin and catalyst.

In use of the anchor assembly of the present invention, a conventional dual compartment cartridge 70 containing resin and catalyst is inserted into a predrilled elongated opening 72 in a mine roof 74.

Figure 6:
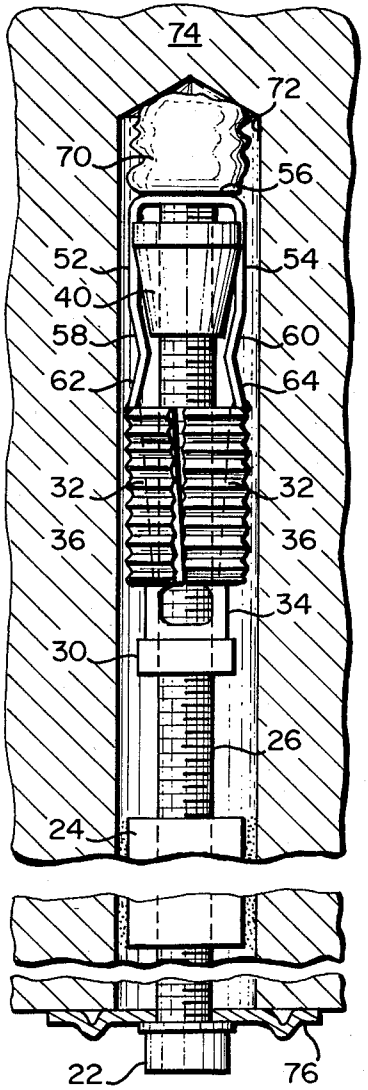
Figure 5:
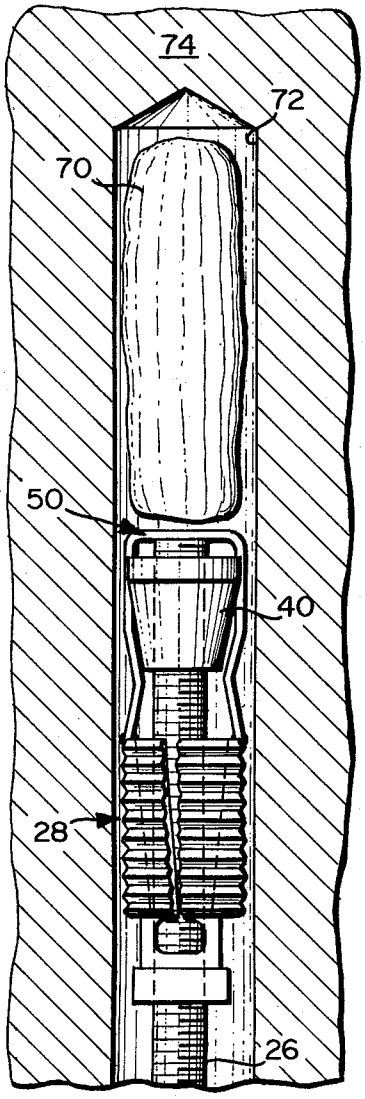
FIG. 5 is a side elevational view of the upper portion of the anchor assembly of the present invention, showing the bail member in deflected position.

The anchor assembly of the present invention is next inserted into opening 72, as illustrated in FIG. 5, which forces cartridge 70 to the back of the opening. Continued upward pressure on the assembly ruptures cartridge 70 to expel the resin and catalyst into opening 72 above expansion shell 28. As the assembly is forced upwardly to its uppermost limit, a standard support plate 76, carried by bolt part 20 above head 22, engages the mine roof as shown in FIG. 6.

Figure 8:
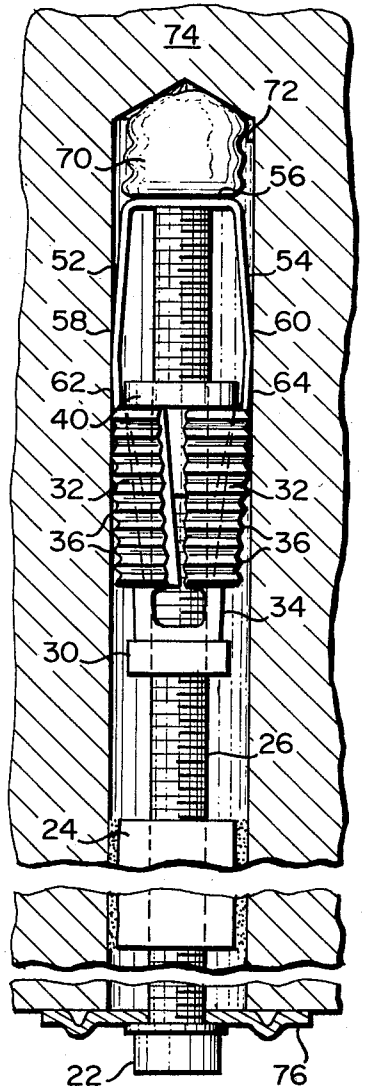
FIGS. 6 to 8 are sectional views through a mine roof opening showing the successive stages in the installation of the anchor assembly of the present invention.
Figure 7:
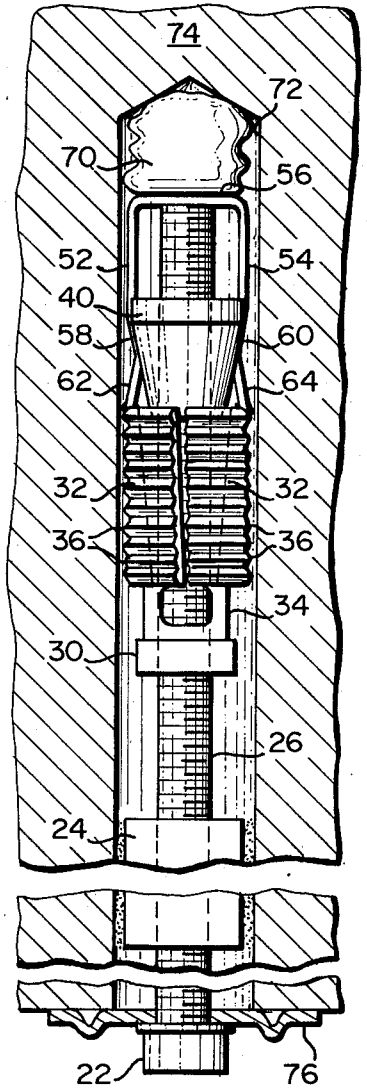

As the resin and catalyst gravitate past the expansion shell to the area of rebar 24, bolt parts 20 and 26, and rebar 24 are rotated while expansion shell 28 is held in frictional engagement with wall 74 to prevent rotation thereof. This causes cone nut 40 to move longitudinally downwardly on bolt part 26, past the restriction formed by bent leg portions 58 and 60 of bail member 50, as shown in FIG. 7. This forces wedge segments 32 into greater frictional engagement with the opening wall. Continued rotation of the elongated bolt and rebar in the same direction results in a downward movement of cone nut 40 axially through the expansion shell segments, the tapered surfaces of cone nut 40 and wedge segments 32 effecting outward movement of the segments in a well-known manner into engagement with mine roof 74 to securely hold the expansion shell in position, as shown in FIG. 8.

At this time, sufficient torque develops due to tension in the bolt, to stall the drill and indicate secure engagement of the shell with the mine roof.

Simultaneously, the bolt and rebar have been rotated a sufficient number of revolutions to effect proper mixture of the resin and catalyst, without undermixing or overmixing the resin and catalyst, approximately 20 revolutions having been found to produce the best results.

The anchor assembly of the present invention affords simple and economic means for combining the gripping forces of an expansion shell anchor and a resin anchor in a single assembly which securely and firmly holds a mine roof bolt in a roof opening, thereby positively minimizing the chances of failure of the anchor assembly after installation.

The present assembly furthermore may be readily installed in the mine roof opening in one continuous operation by inserting the assembly in the opening and then rotating the bolt in one direction only. During this operation, the resin and catalyst are automatically mixed to the proper degree and the expansion shell sequentially activated into gripping engagement with the mine roof.

Although there has been herein shown and described the presently preferred form of this invention, it is to be understood that various changes may be made therein within the scope of the appended claims.

What is claimed is:

1. A mine roof anchor assembly in combination with a dual compartment resin and cartridge inserted into a mine roof opening, the anchor assembly including:

(a) an elongated bolt having a head at one end and threaded for a portion of its length at the other end (b) an expansion member engaged with the threaded end of said bolt (c) said expansion member including an expansion shell, a bail member connected to said expansion shell, said bail member being in overlying contiguous engagement with the threaded end of said bolt (d) a first means adjacent said expansion member carried by, and rotatable with, said elongated bolt for mixing the resin and catalyst upon rotation thereof (e) the resin and catalyst cartridge being ruptured by said assembly when it is forced upwardly into the mine roof opening, thereby permitting the resin and catalyst to gravitate downwardly between the wall of the mine roof opening and said first means, the resin and catalyst being mixed together upon rotation of said first means (f) said expansion shell frictionally engaging the wall of the mine roof opening during rotation of the elongated bolt and said first means to hold the expansion member stationary, and (g) a wedge member threaded on said elongated bolt for engagement with said expansion shell, to urge the latter into gripping engagement with the mine roof (h) a second means for preventing rotational movement of said wedge member during rotation of the bolt, whereby, when said bolt is rotated, said wedge member is threaded longitudinally of the bolt into expanding engagement with said expansion shell (i) said wedge member in its entirety being initially positioned on said elongated bolt in longitudinally spaced relation to said expansion shell, the distance between said wedge member and said expansion shell being determined by the number of revolutions required to properly mix the resin and catalyst to act as a setting agent, after which continued rotation of said elongated bolt in the same direction effects activation of said expansion shell into gripping engagement with the roof, with resultant tensioning of the elongated bolt.

2. The mine roof anchor assembly of claim 1, wherein (a) said first means comprises a rebar.

3. The mine roof anchor assembly of claim 2, wherein (a) said rebar is positioned on said elongated bolt between said expansion member and the head of the bolt.

4. The mine roof anchor assembly of claim 1, wherein (a) said expansion shell includes a plurality of wedge segments, the inner surface of each of which is tapered from top to bottom, and (b) said wedge member comprises a nut, the outer surface of which is tapered inwardly from a point near its top to the bottom thereof, for sliding engagement with the tapered inner surfaces of each of said wedge segments, to urge the latter outwardly into gripping engagement with that portion of the mine roof defining the mine roof opening.

5. The mine roof anchor assembly of claim 1, wherein (a) said bail member is of substantially inverted U-shape and includes like, spaced legs joined at their upper end by a connecting portion which overlies the wedge member, the lower ends of said legs being secured to said expansion shell.

6. The mine roof anchor assembly of claim 5, wherein (a) diametrically opposite sides of said wedge member are cut away to provide longitudinal grooves for receiving the spaced legs of said bail member to prevent relative rotation of said wedge nut and expansion member.

7. The mine roof anchor assembly of claim 6, wherein (a) an intermediate portion of the legs of said bail member are bent inwardly to provide a restricted passageway, the width of which is less than the diameter of said wedge nut, whereby premature engagement of said wedge nut and expansion shell is prevented.

8. A mine roof anchor assembly in combination with a dual compartment resin and cartridge inserted into a mine roof opening, the anchor assembly including (a) an elongated bolt having a head at one end and threaded for a portion of its length at the other end (b) an expansion member engaged with the threaded end of said bolt (c) said expansion member including an expansion shell comprising a plurality of wedge segments, the inner surface of each of which is tapered from top to bottom (c) a bail member of substantially inverted U-shape in overlying contiguous relation with the threaded end of said bolt (d) said bail member having like, spaced legs joined at their upper end by a connecting portion which overlies the elongated bolt, the lower ends of said legs being secured to said expansion shell (e) rebar adjacent said expansion member carried by, and rotatable with, said elongated bolt for mixing the resin and catalyst upon rotation thereof (f) the resin and catalyst cartridge being ruptured by said assembly when it is forced upwardly into the mine roof opening, thereby permitting the resin and catalyst to gravitate downwardly between the wall of the mine roof opening and said rebar, the resin and catalyst being mixed together upon rotation of said rebar (g) said expansion shell frictionally engaging the wall of the mine roof opening during rotation of the elongated bolt and said rebar to hold the expansion member stationary, and (h) a wedge member comprising a nut threaded on said elongated bolt, the outer surface of said nut being tapered inwardly from a point near its top to the bottom thereof, for sliding engagement with the tapered inner surface of each of said wedge segments, to urge the latter outwardly into gripping engagement with that portion of the mine roof defining the mine roof opening (i) diametrically opposite sides of said nut being cut away to provide longitudinal grooves receiving the spaced legs of said bail member to prevent relative rotation of said nut and expansion member, whereby, when said bolt is rotated, said nut is threaded longitudinally of the bolt into expanding engagement with said expansion shell (j) said nut in its entirety being initially positioned on said elongated bolt in longitudinally spaced relation to said expansion shell, the distance between said nut and expansion shell being determined by the number of revolutions required to properly mix the resin and catalyst to act as a setting agent, after which continued roation of said elongated bolt in the same direction effects activation of said expansion shell into gripping engagement with the roof, with resultant tensioning of the elongated bolt.

9. The mine roof anchor assembly of claim 8, wherein (a) an intermediate portion of the legs of said bail member are bent inwardly to provide a restricted passageway, the width of which is less than the diameter of said wedge nut, whereby premature engagement of said wedge nut and expansion shell is prevented.

* * * * *